US006305441B1

(12) United States Patent
Till

(10) Patent No.: US 6,305,441 B1
(45) Date of Patent: Oct. 23, 2001

(54) DEVICE FOR CLEANING A TAPPING HEAD ARRANGEMENT FOR TAPPING BEVERAGES PRESSURIZED BY GAS

(75) Inventor: Rudolf Till, Baden-Baden (DE)

(73) Assignee: IPE Engineering GmbH, Bühl (DE)

( * ) Notice: Subject to any disclaimer, the term of this patent is extended or adjusted under 35 U.S.C. 154(b) by 0 days.

(21) Appl. No.: 09/693,087

(22) Filed: Oct. 20, 2000

(30) Foreign Application Priority Data

Oct. 25, 1999 (DE) ..... 299 18 785 U

(51) Int. Cl.[7] ..... B65B 1/04; B65B 3/04; B67C 3/02

(52) U.S. Cl. ..... 141/90; 141/91; 141/99; 141/104; 141/347; 134/22.11; 134/169 C; 137/240

(58) Field of Search ..... 141/89–91, 99, 141/100, 104, 346, 347; 134/22.1, 22.11, 22.13, 169 R, 169 C; 222/148; 137/237–240

(56) References Cited

U.S. PATENT DOCUMENTS

| | | | | |
|---|---|---|---|---|
| 3,734,352 | | 5/1973 | Dooley . | |
| 4,212,414 | | 7/1980 | Beyens . | |
| 4,228,927 | | 10/1980 | Beyens et al. . | |
| 5,095,572 | * | 3/1992 | Wagner | 15/3.51 |
| 5,336,334 | * | 8/1994 | Johnson | 134/22.14 |
| 5,343,907 | | 9/1994 | Wagner . | |
| 5,535,923 | | 7/1996 | Fujioka . | |

FOREIGN PATENT DOCUMENTS

| | | |
|---|---|---|
| 28 31 463 | 2/1979 | (DE) . |
| 91 09 177.2 | 12/1991 | (DE) . |
| 34 38 415 | 5/1994 | (DE) . |
| 0 759 409 | 8/1996 | (EP) . |
| 2 659 074 | 2/1991 | (FR) . |
| WO95/11191 | 4/1995 | (WO) . |

* cited by examiner

*Primary Examiner*—Timothy L. Maust
(74) *Attorney, Agent, or Firm*—Collard & Roe, P.C.

(57) ABSTRACT

A device for cleaning a tapping head arrangement for tapping beverages pressurized by gas, the device being able to be reused at a later time by any desired type of tapping head. The device comprises a housing (1) with a connection (3) for the cleaning agent and, with a separate connection (4) for the beverage. The device also has a tubular attachment (2) that can be inserted in the tapping tappet (5) of any desired tapping head (6). A tubular cleaning agent feed line (8) is arranged in this attachment. At its lower end, the feed line has two non-return safety valves (12, 13) arranged in an actuation housing (11). The safety valves can be actuated by an actuating pin (14, 15) attached to the lower part (16) of the flushing tube. In the cleaning position, the tapping tappet (5) presses the actuating pin (14, 15) against the non-return valve (13) to open the cleaning agent feed line, and in the tapping position, the non-return valve (13) blocks the feed of cleaning agent in the beverage direction, and the non-return valve (12) blocks the entry of beverage in the direction of the cleaning channel.

4 Claims, 3 Drawing Sheets

DEVICE FOR CLEANING A TAPPING HEAD ARRANGEMENT FOR TAPPING BEVERAGES PRESSURIZED BY GAS

BACKGROUND OF THE INVENTION

1. Field of the Invention

The invention relates to a device for cleaning a tapping head arrangement for tapping beverages pressurized under gas, the device being intended for refitting any desired tapping head.

2. The Prior Art

Many different proposals have been made in the past for cleaning tapping head arrangements that can be connected to beverage barrels. The known cleaning devices are generally conceived so that they are directly connected to the tapping head arrangement or to the tapping head.

The present invention is based on the problem of providing a device for cleaning a tapping head arrangement that can be refitted on any desired type of tapping head at a later time.

SUMMARY OF THE INVENTION

The present invention proposes to solve the problem by providing a device for cleaning a tapping head arrangement which comprises:

(a) a housing;

(b) a first connection for a cleaning agent on the housing;

(c) a second connection for a beverage on the housing;

(d) a tubular attachment on the housing for insertion in a tapping tappet of the tapping head arrangement;

(e) a tubular cleaning agent feed line arranged in the attachment;

(f) an actuation housing connected to the cleaning agent feed line;

(g) first and second non-return safety valves disposed at a lower end of the cleaning agent feed line and arranged in the actuation housing;

(h) an actuating pin for actuating the safety valves mounted on a lower portion of the cleaning agent feed line so that with the tapping tappet of the tapping head arrangement in the cleaning position, the tapping tappet presses the actuating pin against the second non-return safety valve for opening the feed of cleaning agent, and with the tapping tappet in the tapping position, the second non-return valve blocks the feed of cleaning agent from the beverage line of the tapping head arrangement and the first non-return safety valve blocks the beverage from entry into the cleaning agent feed line.

The device as defined by the invention has the important advantage of being able to be inserted in a simple manner in the tapping tappet of any desired type of tapping head, and be functionally reliable in the inserted condition. This is substantially accomplished in that in the two positions "cleaning position" and "tapping position", any penetration of the respective liquid, for example of the beverage or the cleaning liquid, into zones not intended for such penetration is made impossible.

Special embodiments of the device as defined by the invention are discussed below.

BRIEF DESCRIPTION OF THE DRAWINGS

An example of a preferred embodiment of the device as defined by the invention is explained in the following with the help of the drawings, in which.

DETAILED DESCRIPTION OF PREFERRED EMBODIMENTS

Figure 1:
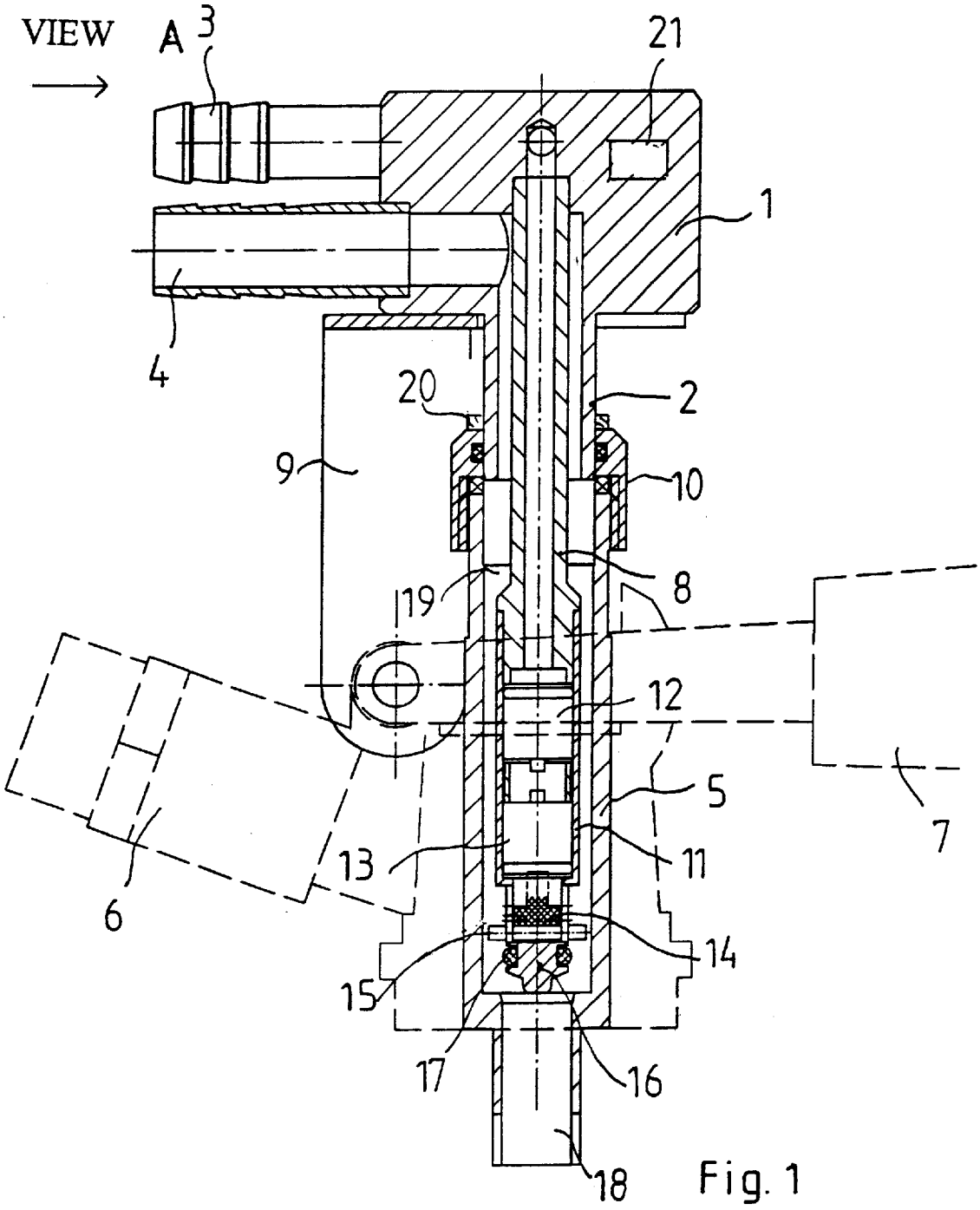
FIG. 1 shows a section through an embodiment as defined by the invention in the tapping position.

As shown in the drawings, the device as defined by the invention consists of a housing 1 that has a tubular attachment 2 on the underside. A connection 3 for the cleaning agent and a connection 4 for the beverage feed into housing 1.

Tubular attachment 2 may be inserted in a cylindrical tapping tappet 5 of any desired type of tapping head. The tapping head 6 and the lever 7 for actuating tapping tappet 5 are shown by dashed lines. Connection 3 for the cleaning agent is connected with a flushing tube 8 that is centrally arranged in the interior of tubular attachment 2. The flushing liquid is contained in the interior of the attachment.

Housing 1 is connected with tapping head 6 by means of a fastening bow 9. Tapping tappet 5 is connected with tubular attachment 2 via a cap nut 10.

Figure 2:
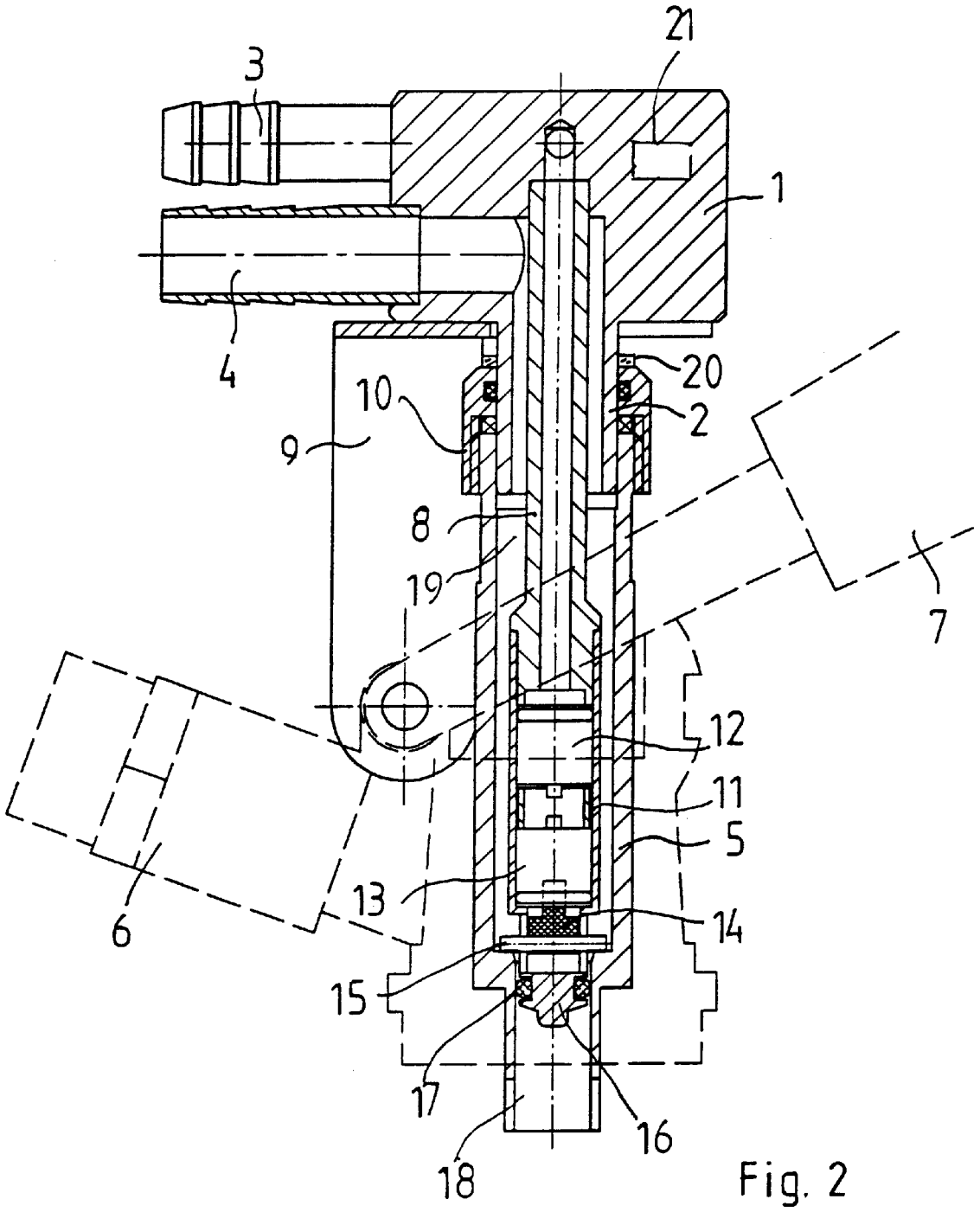
FIG. 2 shows a section through the same arrangement according to FIG. 1 in the cleaning position.

Tapping tappet 5 can be set in two positions by means of lever 7, namely to the tapping position (FIG. 1) and to the down position (FIG. 2).

Two non-return safety valves 12, 13 are accommodated in the lower end of flushing tube 8 in an actuation housing 11. The non-return safety valves can be actuated by means of the actuating pin 14, 15. Furthermore, on its underside, the actuation housing has a bottom part 16 of the flushing tube, and an O-ring 17.

The mode of operation of the device according to FIG. 1, i.e. in the down position, or in the tapping position, is explained as follows: When the tapping head is in the position shown in FIG. 1, the beverage can be tapped from the beverage container via an opening 18. The beverage then flows at the connection tappet 2 through a beverage channel 19 from beverage connection 4 into the beverage line, and from there via the spigot into the glass. When situated in this position, the cleaning channel is blocked in the direction of the beverage line by non-return safety valve 13. The non-return safety valve 12 prevents the beverage from entering the cleaning channel of line 8.

In the down position, i.e. in the cleaning position according to FIG. 2, the tapping system with the beverage line can be cleaned via a cleaning system connected through cleaning agent connection 3. Tapping tappet 5 presses actuating pin 14, 15 against non-return safety valve 13 and opens it. Cleaning agent via cleaning agent connection 3 can then flow into the beverage line via beverage connection 4, and the entire tapping system can be cleaned in this manner.

Figure 3:
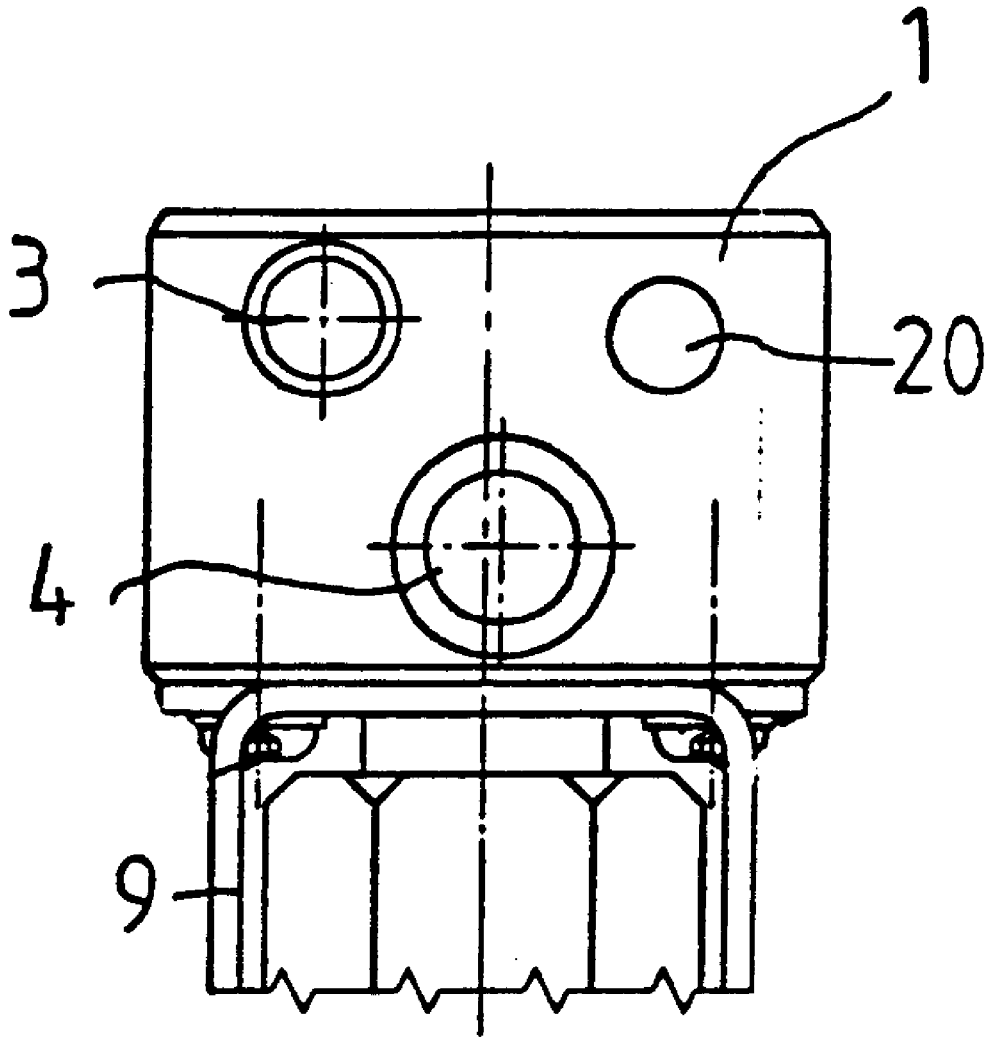
FIG. 3 shows a view along line "A" in FIG. 1.

Furthermore, as shown in FIGS. 1–3, a ring-shaped permanent magnet 20 is arranged on top of cap nut 10. This permanent magnet cooperates with a Reed relay 21 in order to assure in this way that the cleaning process is carried out automatically.

The tapping head can be equipped also with automatic actuation, for example in the form of an electric motor or a hydraulic or pneumatic system.

With the device as defined by the invention, cleaning of the entire tapping system can advantageously be started with the same actuating lever, i.e. the same lever that is used also for starting the tapping process. Furthermore, the cleaning process can be carried out also automatically if the Reed relay or another proximity switch is employed.

While several embodiments of the present invention have been shown and described, it is to be understood that many changes and modifications may be made thereunto without departing from the spirit and scope of the invention as defined in the appended claims.

What is claimed is:

1. A device for cleaning a tapping head arrangement for tapping beverages pressurized by gas, the tapping head arrangement having a beverage line, a tapping position and cleaning position, which comprises:

(a) a housing;

(b) a first connection for a cleaning agent on the housing;

(c) a second connection for a beverage on the housing;

(d) a tubular attachment on the housing for insertion in a tapping tappet of the tapping head arrangement;

(e) a tubular cleaning agent feed line arranged in said attachment;

(f) an actuation housing connected to the cleaning agent feed line;

(g) first and second non-return safety valves disposed at a lower end of said cleaning agent feed line and arranged in the actuation housing;

(h) an actuating pin for actuating the safety valves mounted on a lower portion of said cleaning agent feed line so that with the tapping tappet of the tapping head arrangement in the cleaning position, the tapping tappet presses the actuating pin against the second non-return safety valve for opening the feed of cleaning agent, and with the tapping tappet in the tapping position, the second non-return valve blocks the feed of cleaning agent from the beverage line and the first non-return safety valve blocks beverage from entry into the cleaning agent feed line.

2. The device according to claim 1 further comprising:

(a) a fastening bow arranged on the housing and connectable with the tapping head arrangement; and (b) a cap nut connecting via the tubular attachment the housing with the tapping tappet of the tapping head arrangement.

3. The device according to claim 2 further comprising:

(a) a relay responding to magnetic field lines arranged in the housing;

(b) a ring-shaped magnet cooperating with the relay arranged at an upper end of the cap nut.

4. The device according to claim 3 wherein the relay comprises a Reed contact relay.

* * * * *